United States Patent [19]

Mogi

[11] Patent Number: 5,054,729

[45] Date of Patent: Oct. 8, 1991

[54] MANIKIN HEAD SUPPORT

[76] Inventor: Shoichi Mogi, 240 S. Wetherly Dr., Beverly Hills, Calif. 90211

[21] Appl. No.: 530,234

[22] Filed: May 30, 1990

[51] Int. Cl.[5] ..... A45D 8/00

[52] U.S. Cl. ..... 248/225.31; 248/231.4; 248/118

[58] Field of Search ..... 248/225.31, 231, 231.2, 248/231.4, 231.7, 231.8, 316.4, 118; 297/191, 188, 391, 399–402, 397, 414

[56] References Cited

U.S. PATENT DOCUMENTS

| | | | |
|---|---|---|---|
| 2,551,157 | 5/1951 | Price | 248/231.7 X |
| 2,867,401 | 1/1959 | Sheahan | 248/231.4 |
| 2,874,757 | 2/1959 | Requa | 297/400 |
| 3,151,911 | 10/1964 | Eichorst | 297/397 |
| 3,271,072 | 9/1966 | Barker | 297/397 |
| 3,276,734 | 10/1966 | Goldblatt | 248/176 |
| 3,288,415 | 11/1966 | Eickhoff | 248/231.7 |
| 3,424,419 | 1/1969 | Siegel | 248/231.7 |
| 3,448,957 | 6/1969 | Friedman | 248/231.7 |
| 3,489,383 | 1/1970 | Anson | 248/231.7 |
| 3,572,825 | 3/1971 | Davis | 297/188 |
| 3,586,281 | 6/1971 | Schumer | 248/231.7 |
| 3,596,862 | 8/1971 | Block | 248/231.4 X |
| 3,934,804 | 1/1976 | Bruce | 248/231.7 X |
| 3,939,986 | 2/1976 | Pierro | 248/231.4 X |
| 4,498,704 | 2/1985 | Hildreth | 297/397 |

FOREIGN PATENT DOCUMENTS

| | | | |
|---|---|---|---|
| 1953141 | 4/1971 | Fed. Rep. of Germany | 297/397 |

*Primary Examiner*—Karen J. Chotkowski

*Attorney, Agent, or Firm*—Arthur Freilich; Robert D. Hornbaker; Leon D. Rosen

[57] ABSTRACT

An apparatus is described for mounting a manikin head with a wig thereon, so the wig occupies substantially the same position as the head of a person seated on a chair in a beauty shop. The apparatus includes a mount device that lies on the top of a chair back and is pressed against the front and rear faces of the chair back, and which holds a pedestal on which a manikin head is mounted. The mount device includes front and rear mounts (20, 22), each including a plate having a vertical plate part (22) for lying against one face of the chair back and a top plate part (26) for lying over the top of the chair back. The mounts are positioned with the top plate part of a second mount lying on the top of the chair back, and the other top plate part of the rear mount lying on the first one. The pedestal screws onto the front top plate part and has a narrow bottom to fit into a slot (60) in the front top plate part. A strap (40) extends around the chair back to hold the two mounts securely in place.

1 Claim, 1 Drawing Sheet

MANIKIN HEAD SUPPORT

BACKGROUND OF THE INVENTION

Hair stylists must sometimes cut the hair of a wig while it lies on a manikin's head. During cutting of the wig, it is desirable that the cutting operation simulate the cutting of a person's hair while he/she is seated in the barber or stylist's chair of a salon. This simulation of cutting of a person's hair is useful in the training of hair stylists by cutting a wig in a situation as close as possible to the cutting of a seated person's hair. Such simulation is also useful when an accomplished stylist must cut a wig supplied by a factory with long straight hair, which requires the stylist to meet the requirements of the purchaser. The ability to mount a manikin's head which holds a wig, in a position closely simulating the cutting of a real person's hair in a salon, in a simple and low cost manner, would be of considerable value.

SUMMARY OF THE INVENTION

In accordance with one embodiment of the present invention, a relatively simple and low cost apparatus is provided for detachably mounting a manikin head, so a wig thereon can be cut in a manner closely simulating the cutting of the hair of a person seated in a chair in a hair stylist's salon. The apparatus includes a mount device that mounts on the top of a chair back and is clamped against the front and rear faces of the chair, and which holds a pedestal on which a manikin head is mounted. As a result, the manikin head lies at substantially the same position as a person's head, and can lie on the same stylist's chair which would otherwise hold a client, to enable the cutting of a wig on the manikin head in a manner closely simulating cutting of a person's hair.

The mount device can include front and rear mounts, each including a plate having a vertical plate part that lies against the front or rear face of a chair back, and a top plate part which lies over the top of the chair back. The mounts are arranged with the vertical plate parts lying against opposite faces of the chair back, with the top part of a second mount lying on the chair back and the top part of the other lying on the first one. A pair of straps extends around the chair back and holds the two mounts tightly against opposite faces of the chair back.

The novel features of the invention are set forth with particularity in the appended claims. The invention will be best understood from the following description when read in conjunction with the accompanying drawings.

DESCRIPTION OF THE PREFERRED EMBODIMENT

Figure 1:
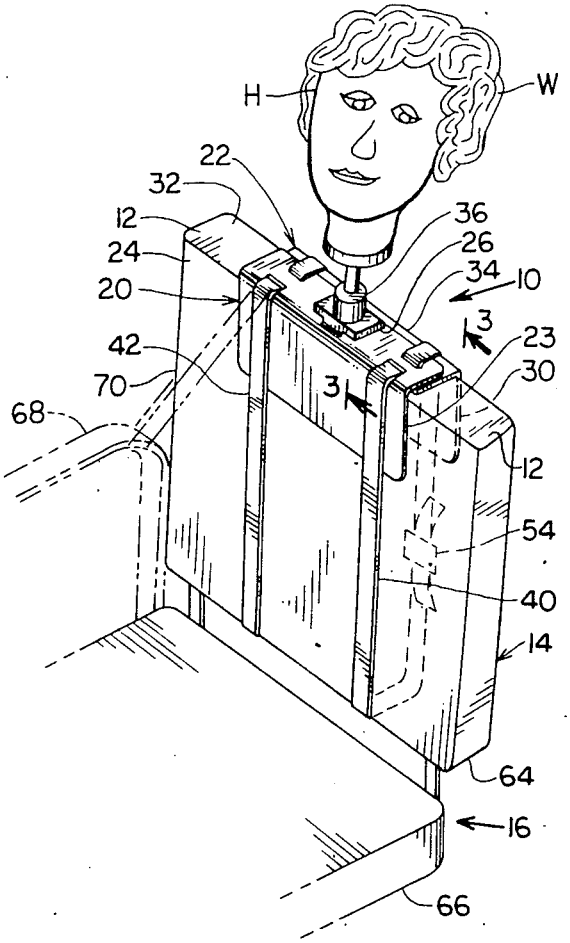
FIG. 1 is a perspective view of apparatus constructed in accordance with the present invention for holding a manikin head with wig thereon, shown mounted on a chair back.

FIG. 1 illustrates a mount device 10 which can hold a manikin head H with a wig W thereon, so hair of the wig can be cut or otherwise groomed by a hair stylist, in a manner closely simulating cutting of an actual person's hair in a salon. Applicant achieves such holding of the manikin head by constructing the mount so it mounts on the top 12 of a chair back 14 of a chair 16. The chair 16 can be a salon chair on which a client normally sits, and which may be constructed to enable the chair to be raised or lowered, pivoted about a vertical axis, and/or tilted back or forward. The mount device 10 holds the manikin head so it lies at about the same position as the client's head. This apparatus is useful to train stylists, by allowing them to cut the hair of a wig on the manikin, with the position of the manikin head simulating that of a client, and with the trainee possibly operating the same controls in the same environment as he would employ them in cutting an actual client's hair. The setup is also useful for an experienced stylist, to enable her to cut an unstyled wig, supplied by the factory unstyled and with long hair, to fit the requirements of the purchaser. Because the wig lies at the same position as the purchaser's head would lie if she were seated in the chair, and because the stylist can use the same equipment and in the same setting she would use to trim the client's hair, the wig can be cut with high craftsmanship.

The mount device includes a first or front mount 20 and a second or rear mount 22 which are supported on the upper portion of the chair back. Each mount is formed of a metal plate that is bent to form perpendicular plate parts. The first mount includes a first vertical plate part 23 which lies against the front face 24 of the chair back, and a first top plate part 26 which lies over the top 12 of the chair back. The second mount 22 includes a second vertical plate part 30 which lies against the rear face 32 of the chair back, and a second top plate part 34 which lies over the top of the chair back. A manikin head-holding pedestal 36 is attached to the middle of the second top plate part 34.

Figure 2:
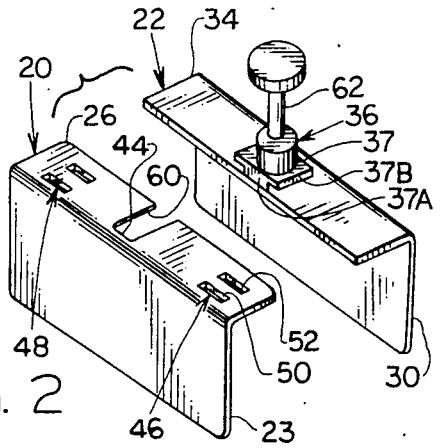
FIG. 2 is an exploded view of the mount apparatus of FIG. 1, but without the straps or manikin head.
Figure 3:
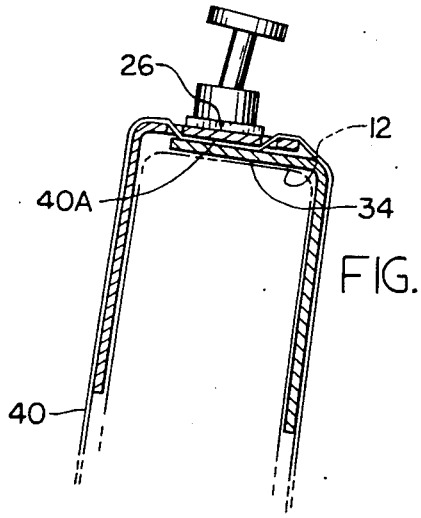
FIG. 3 is a view taken on the line 3—3 of FIG. 1.

The front and rear mounts are held closely against the chair back by a pair of straps 40, 42 that substantially encircle the chair back and press the vertical plate parts 22, 30 tightly against opposite faces of the chair and the top plate parts 26, 34 tightly down towards the chair top. As shown in FIG. 2, the first top plate part 26 has a middle at 44, and has pairs of slots 46, 48 at opposite sides of the middle. Each strap can be threaded through the slots 50, 52 of a pair to hold the strap from wandering sidewardly, and the strap can extend around the chair back and be tied to itself, as at a strap fitting 54. The top plate parts 26, 34 preferably lie with the second top plate part 34 on the top of the chair back, and the first top plate part 26 lying substantially on the first top plate part 34. FIG. 3 shows such an arrangement, although a portion 40A of the strap slightly separates the top plate parts 26, 34.

Figure 4:
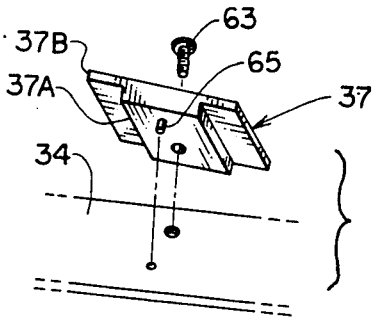
FIG. 4 is an exploded perspective view of part of the pedestal and of the rear mount.

The first top plate part 26 (FIG. 2) has a slot 60 which receives the pedestal 36, to allow wide areas of the top plate parts to lie substantially adjacent to one another. It may be noted that a pedestal with a wide base 37 can be used, with a narrow lower base portion 37A which fits into the slot 60 and with a wider upper base portion 37B lying above the first top plate part 26. It may be noted that applicant prefers to use a pedestal of a type which includes a rod 62 having a ball at its lower end which can pivot to different positions, and which can be locked to any pivotal position by a locking bar (not shown). As shown in FIG. 4, the pedestal base 37 is fastened by a screw 63 to the top plate part 34, and is held from rotation by a peg 65 that fits into a hole in the top plate part.

Some chairs are of the type shown in solid lines in FIG. 1, which include a lower edge 64 separated from the chair seat 66, so the straps can extend in a simple loop about the chair back. Other chairs do not have a space between its chair back and seat, but include an arm rest indicated at 68. In that case, the straps can extend about the arm rests, so that each strap extends about a side edge such as 70 of the seat back. With the straps tightened, they still hold the mount 20, 22 securely in place. It may be noted that applicant prefers to position the top of the second mount 22 which holds the pedestal 36 so it lies under the top of the first mount. This has the advantage that the top plate part 34 that holds the pedestal is sandwiched between two other parts (part 26 and the chair top 12) so it and the manikin head thereon are securely held.

Thus, applicant provides apparatus for mounting a manikin head, so a hair stylist can cut the hair of the wig on the head or perform other services therefor, with wig in substantially the same position as the hair of a seated person. This is accomplished by a mount device which holds a pedestal for holding a manikin head, with the mount device mountable on the top of the back of a chair. The mount device can include two mounts, each having a largely vertical plate part with one lying against the front face of a chair back and the other lying against the rear face of a chair back. Each mount also has a top part extending largely perpendicular to its vertical plate part, with one top part lying on the top of the chair back and the other lying on the first top part. The pedestal is attached to one of the top plate parts and fits into a slot in the other top plate part. A pair of straps extend around the chair back to hold the mounts tightly together and against the chair back.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. Apparatus for mounting a manikin head with a wig, at the level of a seated person, for enabling cutting of the wig by a hair stylist, comprising:

a chair having a chair back with front and rear faces and a top;

a first mount having a primarily horizontal plate-like top part lying on said seat top, and a primarily vertical plate-like part lying against a first of said chair back faces;

a manikin head-holding pedestal mounted on said plate-like top part of said first mount;

a second mount having a primarily horizontal plate-like top part lying on said first mount top part and having a slot that receives said pedestal, said second mount having a plurality of strap-receiving slots and having a primarily vertical plate-like side part lying against a second of said seat back faces;

a pair of straps, each extending around said seat back, in a path extending through at least one of said slots and around said vertical plate-like parts of said first and second mounts.

* * * * *